US006871995B2

(12) United States Patent
Simba

(10) Patent No.: US 6,871,995 B2
(45) Date of Patent: Mar. 29, 2005

(54) DRINKING VESSEL STIRRER

(76) Inventor: Leonard L. Simba, 193 Dexter Street, Winnipeg Manitoba (CA), R2R2L7

( * ) Notice: Subject to any disclaimer, the term of this patent is extended or adjusted under 35 U.S.C. 154(b) by 147 days.

(21) Appl. No.: 10/313,872

(22) Filed: Dec. 9, 2002

(65) Prior Publication Data

US 2003/0179647 A1 Sep. 25, 2003

(30) Foreign Application Priority Data

Mar. 19, 2002 (CA) ..... 2376628

(51) Int. Cl.[7] ..... B01F 11/04; B01F 13/00
(52) U.S. Cl. ..... 366/129; 366/276; 366/343
(58) Field of Search ..... 366/276, 243, 366/255, 343, 130, 129

(56) References Cited

U.S. PATENT DOCUMENTS

| | | | | |
|---|---|---|---|---|
| 692,466 A | * | 2/1902 | Morris | 222/241 |
| 1,279,306 A | * | 9/1918 | Eggleston | 366/243 |
| 1,296,326 A | * | 3/1919 | Scollon | 366/242 |
| 3,138,371 A | | 6/1964 | Feher | |
| 4,435,084 A | | 3/1984 | Calhoun | |
| 4,530,606 A | | 7/1985 | Hopkins | |
| 5,151,720 A | | 9/1992 | Kanbar | |
| 5,425,579 A | | 6/1995 | Sampson | |
| 5,586,676 A | | 12/1996 | Lynd | |
| 5,720,552 A | | 2/1998 | Schindlegger | |
| 5,761,819 A | | 6/1998 | Ledy-Gurren | |
| 5,765,947 A | | 6/1998 | Dubroy | |
| 5,911,504 A | | 6/1999 | Schindlegger, Jr. | |
| 5,979,657 A | | 11/1999 | Bumbera | |
| 6,056,206 A | | 5/2000 | Whiton | |
| 6,210,032 B1 | * | 4/2001 | Murphy | 366/147 |
| 6,305,832 B1 | | 10/2001 | Huang | |
| 6,399,126 B1 | | 6/2002 | Weldon, Jr. | |

FOREIGN PATENT DOCUMENTS

JP 2000-83787 * 3/2000

* cited by examiner

*Primary Examiner*—Tony G. Soohoo

(57) ABSTRACT

A finger operated and spring loaded stirring device mounted on a drinking vessel comprising a tab coupled to a paddle. Said paddle is submerged in a liquid content of said vessel, and having a planar curvature that coincides with the drinking vessel wall contour, and moves in an arc linear motion about a fixed pivot when said tab is operated and released by a thumb finger of the same hand holding the drinking vessel. This creates a stirring or mixing action when said sequence of operation is repeated many times

| | | |
|---|---|---|
| 10 Drinking vessel | 20 Tab | 30 Spring |
| 11 Drinking vessel pivot | 21 Stirrer pivot | 31 Pivot axle |
| 12 Liquid content of vessel | 22 Paddle | |
| 13 Handle of drinking vessel. | | |

5 Claims, 1 Drawing Sheet

DRINKING VESSEL STIRRER

CROSS REFERENCE TO RELATED APPLICATIONS

| application Ser. No. | Date Filed in U.S. |
|---|---|
| 09/945,992 | Sep. 4, 2001 |
| 09/827,691 | Nov. 1, 2001 |
| 10/012,239 | Nov. 13, 2001 |

| Application Number | Date Filed in Canada |
|---|---|
| 2,376,628 | Mar. 3, 2002 |

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to finger operated and spring loaded stirring device mounted on a drinking vessel for stirring the liquid contained therein.

Drinking vessels typified by drinking cups or mugs come in various forms which are basically handheld drinking containers fitted with ear or handle. They commonly hold coffee, tea, chocolate drinks or soup wherein powdered cream, sugar, honey or other condiments are added. Teaspoon or plastic stirring stick is required to mix such ingredients before drinking. As the undissolved or insoluble ingredients settle on the bottom surface of a drinking vessel, another round of stirring is again required. In the absence of stirring stick or teaspoon, it is also a normal practice to mildly shake the cup or mug to help mix said ingredients but there is a risk of spillage when said cup or mug is still partly full.

Stirring also presents limitations in some new plastic insulated mugs which are designed with deep bottoms resulting in the inconvenience of stirring where standard stirring sticks are short.

Most commonly, if the drinking vessel is held up by a drinker, the other free hand is required to hold a stirring stick or teaspoon to mix its liquid content.

This problem of stirring without the use of a free hand is also present during:

(a) Watching sports wherein the other hand holds a snack food;

(b) Leisure vehicle driving wherein at least one hand is required full time on a steering wheel;

(c) At home doing some reading, attending to chores like pressing or ironing clothes or simply talking over a phone.

BACKGROUND OF THE INVENTION: (CONTINUATION)

Prior arts related to stirrers as applied to drinking vessels, drinks and beverages is believed to be categorized as follows:

a) stirrers employing rotary motion by utilizing gears and electric motors as in U.S. Pat. No. 5,911,504 to Schindlegger (1999) and in 9 or more other related patents;

b) stirring rods or sticks of various design e.g. lighted cocktail stirring rod as in U.S. Pat. No. 6,305,853 to Huang (2001) and in 11 or more other related patents;

c) "built in" as in the case of a beverage pitcher with a stirring stick attached to its cover as in U.S. Pat. No. 5,586,676 to Lynd (1996);

d) unique design or idea as in U.S. Pat. No. 3,138,371 to Feher (1964);

e) related but describes the drink stirrer to specific use as in Japanese patent JP200083787 to Hideo (2000) titled "Powder Drink Stirrer".

BACKGROUND OF THE INVENTION: (CONTINUATION)

Therefore the following are major groups where beverage stirrers can be classified, a) related to cup or handheld drinking vessels;
- U.S. Pat. No. 5,586,676 to Lynd (1996)
- U.S. Pat. No. 4,435,084 to Calhoun (1984)
- U.S. Pat. No. 3,138,371 to Feher (1964)

b) rotary stirring;
- U.S. Pat. No. 5,911,504 to Schindlegger, jr. (1999)
- U.S. Pat. No. 5,720,552 to Schindlegger (1998)
- U.S. Pat. No. 5,765,947 to Dubroy (1998)
- U.S. Pat. No. 5,425,579 to Sampson (1995)
- U.S. Pat. No. 4,264,216 to Stansbury, jr. (1981)
- U.S. Pat. No. 3,881,705 to Greenspan (1975)
- U.S. Pat. No. 3,704,864 to Lee (1972)
- U.S. Pat. No. 3,504,816 to Weichsel (1970)
- U.S. Pat. No. 2,920,875 to Marfuggi (1960) and similar more dating back to year 1914 c) vibratory or non rotary stirring;
- U.S. Pat. No. 4,530,606 to Hopkins (1988)

d) manual, cocktail stirrers or swizzle sticks;
- U.S. Pat. No. 6,399,126 to Weldon, jr. (2002)
- U.S. Pat. No. 6,305,832 to Huang (2001)
- U.S. Pat. No. 6,056,206 to Whiton (2000)
- U.S. Pat. No. 5,979,657 to Bumbera (1999)
- U.S. Pat. No. 5,761,819 to Harilela (1998)
- U.S. Pat. No. 5,151,720 to Kanbar (1992)
- U.S. Pat. No. 5,023,761 to le Lange (1991)
- U.S. Pat. No. 4,854,712 to Mori (1989)
- U.S. Pat. No. 5,761,819 to Ledy-Gurren (1988)
- U.S. Pat. No. 4,483,622 to Muhi (1984) and similar more dating back to year 1955

BACKGROUND OF THE INVENTION: (CONTINUATION)

e) stirrer with specific use;
- Japan patent JP2000083787 to Hideo (2000)

f) others with foreign, PCT, and U.S. applications;
- Canada patent 2,055,091 to Sinave (1991)
- PCT filing number PCT/US1996/002951 to Wong
- U.S. application Ser. No. 09/354,678 to Murphy
- U.S. application Ser. No. 256,622 to McClellan Prior arts mentioned above particularly to Lynd wherein a stirrer element has a shank end and is retained in the center of the cap (cover). It is actually a "spoon", being detachable, has a receptacle in said cap. The battery operated cup stirrer of Calhoun (1984) has a switch recessed in the cup's upper end of its handle. This is convenient because the same hand that holds the cup also commands the stirring process. A stirrer of Feher (1964) is made part of the inner wall that convolutes when the flexible container is "squeezed in". Stirring is done by horizontally moving the container so that the beverage is caught in between the stirrer and the wall. As will be explained later, the above mentioned prior arts present more relevant stirring concept to my Drinking Vessel Stirrer.

The remaining prior arts have paid attention to using paddle or spoon on concentric shaft, screw propeller, rotating fins and helical vanes to stir and mix liquids. Some employ electric motor to operate the stirrer. One method was using a drinking vessel with detachable base which houses a motor that resemble very much like a domestic blending appliance. The most elaborate stirrer is even capable of sweeping, turning and flipping action in the case of automatic stirrer fitted in a cooking vessel. Cocktail stirrers are typically manual mixing sticks with dual function and unique style like having electronic light, viewing lens, serving as measuring stick, a condiment container and many more.

BRIEF SUMMARY OF THE INVENTION

This is where the idea behind my drinking vessel stirrer comes in because of the following advantages:

(a) To be able to stir a liquid in a drinking cup or mug by using only a thumb finger of the same hand holding the said cup or mug without the use of motor, gears and batteries;

(b) To be able to make my stirrer an integral part of a drinking vessel without introducing unsightly and obtrusive parts like stirring blades, fins, screws or vanes. My idea is designed in such a way that the paddle's planar curvature follows the contour of the inside wall of the drinking vessel making it unobvious and visually "out of the way".

(c) To be able to do away with separate stirring sticks, spoons or forks for which most often when needed are misplaced, hard to reach, already been used by other person, and contaminated;

(d) To be able to accomplish a good stirring action without the use of intricate parts like blades, propellers or helical vanes which could pose choking hazard to a drinker when the said parts breaks and falls inside a drinking vessel;

(e) To be able to save on stirring sticks which otherwise causes material wastage;

(f) To be able to clean a drinking vessel fitted with a stirrer without elaborate washing of components like the fins, screw, vanes, and propellers as in previously mentioned prior arts thereby saving energy and resources;

(g) To be able to do stirring of a liquid by the natural and instinctive body movement of pushing down a tab with the use one's thumb. Example is watching a TV with a cup of hot coffee in one hand and a TV remote control on the other hand;

(h) At present, there is nothing of similar design or idea on the market.

(i) The idea is new and interesting for children if transparent drinking cups are fitted with my stirrer and they see the effect of turbulence resembling circus of colorful soup ingredients.

DETAILED DESCRIPTION OF THE INVENTION

Typical Embodiment

A drinking vessel as exemplified by a modern mug 10 (FIG. 1) is typically made from glass, plastic, metal or ceramic with handle 13 containing liquid 12. Pivot 11 is an integral part of said mug. Pivot 11 is built over the lip of said mug just above handle 13.

Figure 3:
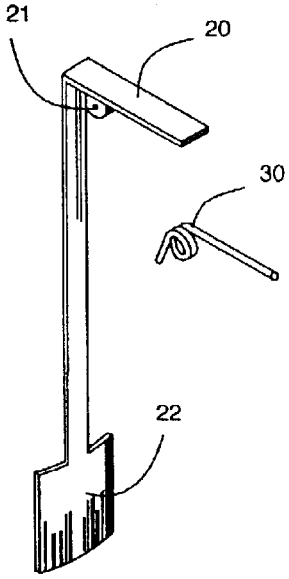
FIG. 3 is an isometric view of the stirrer showing its basic form and parts.
Figure 4:
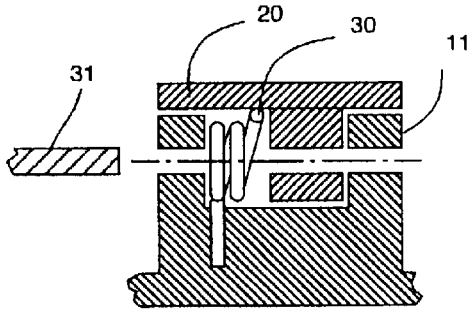
FIG. 4 is a sectional view of the stirrer and drinking vessel pivots, and spring coaxial with pivot pin thereby showing how a vertical lever movement is accomplished.

The stirrer (FIG. 3) made from rigid piece of material comprises a tab 20 with pivot 21 and paddle 22 connected at approximately right angle to said tab. Paddle 22 has planar curvature that follows the contour of the inside wall of mug 10. In the rest position, curvature of paddle 22 and contour of the inside wall of mug 10 coincide. Spring 30 (FIG. 4) is a coil tension spring and is fixed coaxially on pivots 11 and 21 by axle 31. This arrangement permits only vertical lever movement. The fixed arm of spring 30 is held againts the exterior of mug beneath pivot 11 and its movable arm acts underneath tab 20.

Spring 30 can also be a leaf spring.

Tab 20 (FIG. 1) extends outward from mug 10 approximately parallel to the liquid level of said mug. Paddle 22 is submerged in the liquid content of mug 10. The planar shape of paddle 22 (FIG. 2). will give maximum turbulence in liquid 12 when said planar shape travels perpendicularly through liquid 12.

Tab 20 can be retractable or extendible so that when it is not used, the tab is pushed in and "out of the way". To use the stirrer in this way, the holder of mug 10 slides out or flips over tab 20 using the same thumb finger.

Stirrer can also be mounted on drinking vessel cover typical in traveling mugs. So that the drinking vessel can be with or without a stirrer by simply putting in or removing the said cover. In this case, pivot 11 is predisposed on mug cover.

Stirrer can also be a "clip-on" accessory to traditional cups and mugs by simply hooking over the lip of drinking vessels.

DETAILED DESCRIPTION OF THE INVENTION

Operation

Figure 1:
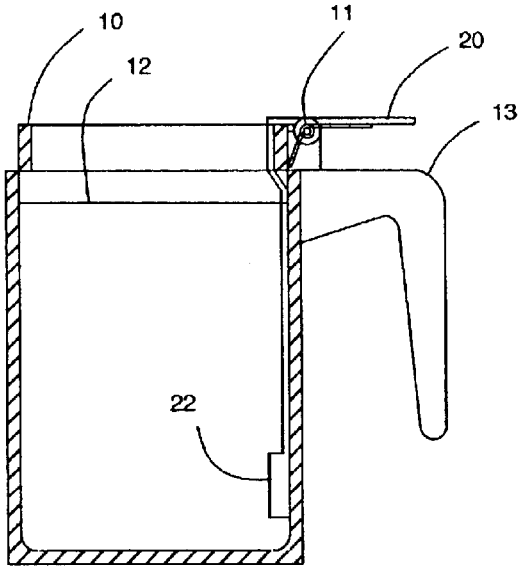
FIG. 1 is a sectional view of stirrer fitted over a typical drinking vessel typified by a modern design mug showing the positioning of major parts.
Figure 2:
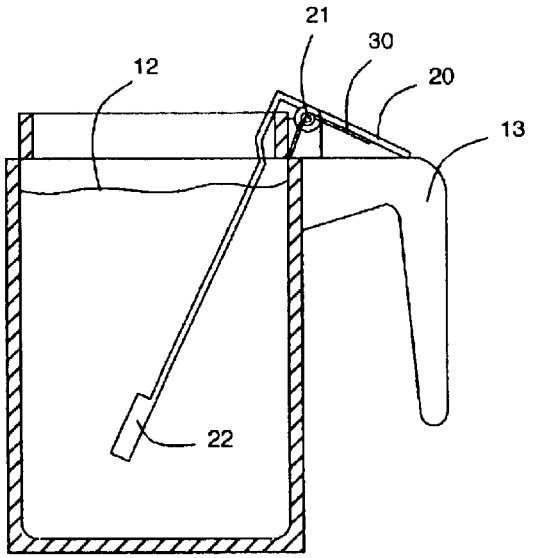
FIG. 2 is a sectional view showing the stirrer tab depressed downward resulting in the stirrer paddle being swung forward.

In the normal and rest position (FIG. 1), paddle 22 is submerged vertically under liquid 12 of drinking vessel 10. Paddle 22 is pulled against the inner wall of said vessel by the force of spring 30. To operate, a thumb finger of a drinker which holds vessel 10 pushes down on tab 20. This action will overcome the force of spring 30. Paddle 22 will move forward in an arc linear motion with respect to pivots 11 and 21 (FIG. 2). The travel of said paddle will be the arc distance towards the opposite wall of mug 10. In vessel design having wide lip diameter, arc travel of paddle 22 is limited by the amount of clearance between tab 20 to handle 13. In the process of travel, paddle 22 will sweep across liquid content 12 of vessel 10. Because paddle 22 has surface area that is approximately perpendicular to its travel, it will impart optimum kinetic energy to liquid 12. This action creates turbulence in said liquid which is actually a stirring process. When the drinker's thumb finger is released from tab 20, the force of spring 30 will prevail and will bring paddle 22 back to its rest position (FIG. 1). Correspondingly, tab 20 will return to its normal position. In the same way as mentioned, this process will again impart some kinetic energy to liquid 12 as paddle 22 travels back to its original position.

If this process is repeated many times, stirring action is achieved.

As previously mentioned stirrer can also be mounted on drinking vessel cover as in the case of most traveling mug which serve as a protection for spillovers and therefore serve as splash protection when the stirrer is operated briskly.

I claim:

1. A stirring device mounted on a drinking vessel for stirring the liquid content therein comprising:

a) a tab formed from a rigid piece of material, and said tab wherein its length extends outside said drinking vessel, and said tab has a form so that a thumb finger of the same hand holding said vessel can reach conveniently and operate comfortably, and said tab has fixed pivot, so that when tab is operated by said finger, the tab moves in a definite and consistent lever action with respect to said pivot;

b) a paddle formed from a rigid piece of material, and said paddle is coupled to said tab, and said paddle wherein its length is predisposed approximately perpendicular with respect to the liquid level in said vessel, and said paddle wherein it is submerged in the liquid content of said vessel, and said paddle wherein its overall length does not touch the bottom surface of said vessel, and said paddle swings forward in arc linear travel when said tab is depressed by a finger, and said paddle wherein its end, opposite to that which is coupled to said tab, has a planar shape predisposed at approximately right angle to its arc linear travel, and said paddle planar shape has a curvature that fits in the contour of the inner wall of said vessel so that said inner wall and paddle planar shape coincide with each other when said paddle is at approximately vertical position;

c) a spring as a means for urging the paddle to return to its approximate vertical position with respect to the liquid 1level in said vessel and the said tab to return to its normal position;

d) and a pair pivots of as means for fixed and consistent lever movement.

2. A stirring device as claimed in claim 1 wherein the tab fixed pivot is coaxial with the pivot predisposed on a drinking vessel.

3. A stirring device as claimed in claim 1 or 2 wherein the pivots are pair elements selected from the group consisting of pins and journals, shafts and rings and set of hinges.

4. A stirring device as claimed in claim 1 wherein the paddle planar shape is made from a thin rigid material wherein its surface area is sufficient to create a optimum hydrodynamic turbulence without spilling the liquid out of said drinking vessel.

5. A stirring device as claimed in claim 1 wherein the paddle curvature surface area coincides with the curvature of the inner wall of a drinking vessel.

* * * * *